US005251958A

United States Patent [19]

Roericht et al.

[11] Patent Number: 5,251,958

[45] Date of Patent: Oct. 12, 1993

[54] SYNCHRONOUS ADJUSTING DEVICE FOR OFFICE CHAIRS OR THE LIKE

[75] Inventors: Hans Roericht, Ulm; Horst Fleischmann, München; Franz Biggel, Wangen; Burkhard Schmitz, Ulm, all of Fed. Rep. of Germany

[73] Assignee: Wilkhahn Wilkening & Hahne GmbH & Co., Bad Münder, Fed. Rep. of Germany

[21] Appl. No.: 752,503

[22] PCT Filed: Dec. 21, 1990

[86] PCT No.: PCT/DE90/00994

§ 371 Date: Aug. 29, 1991

§ 102(e) Date: Aug. 29, 1991

[87] PCT Pub. No.: WO91/09554

PCT Pub. Date: Jul. 11, 1991

[30] Foreign Application Priority Data

Dec. 29, 1989 [DE] Fed. Rep. of Germany ..... 3943282

[51] Int. Cl.[5] ..... A47C 1/02

[52] U.S. Cl. ..... 297/321; 297/322

[58] Field of Search ..... 297/316, 317, 320–322, 297/354, 340–342

[56] References Cited

U.S. PATENT DOCUMENTS

| | | | |
|---|---|---|---|
| 1,888,471 | 11/1932 | Robbins . | |
| 2,679,285 | 5/1954 | Luckhardt | 297/321 |
| 2,679,286 | 5/1954 | Luckhardt | 297/317 |
| 2,730,164 | 1/1956 | Higley et al. | 297/321 |
| 4,768,829 | 9/1988 | Goldman | 297/342 X |
| 4,877,291 | 10/1989 | Taylor . | |
| 4,988,145 | 1/1991 | Engel | 297/322 X |

FOREIGN PATENT DOCUMENTS

| | | | |
|---|---|---|---|
| 0309804 | 4/1989 | European Pat. Off. . | |
| 2359440 | 11/1973 | Fed. Rep. of Germany | 297/317 |
| 8629091 | 2/1987 | Fed. Rep. of Germany . | |
| 8303957 | 11/1983 | PCT Int'l Appl. . | |
| 724305 | 2/1955 | United Kingdom . | |

*Primary Examiner*—Kenneth J. Dorner
*Assistant Examiner*—James M. Gardner
*Attorney, Agent, or Firm*—Spencer, Frank & Schneider

[57] ABSTRACT

A synchronous adjusting device is proposed as a chair mechanism for office chairs, seat furniture or the like, which is constructed extremely simply and with few mechanical components and which, if appropriate, can do without additional force accumulators. At the same time, the restoring movement of the back part will take place as a function of the weight of the user, a restoring moment occurring with the increase in inclination of the backrest. For this, the back part (7) is mounted rotatably relative to the seat part (5) at a distance in height. The leaning force (9) of the user at the back leaning point (10) is counteracted by a restoring force in the lower region of the back part as a result of the articulated connection between the seat part and the back part (7).

7 Claims, 4 Drawing Sheets

Figure 1:
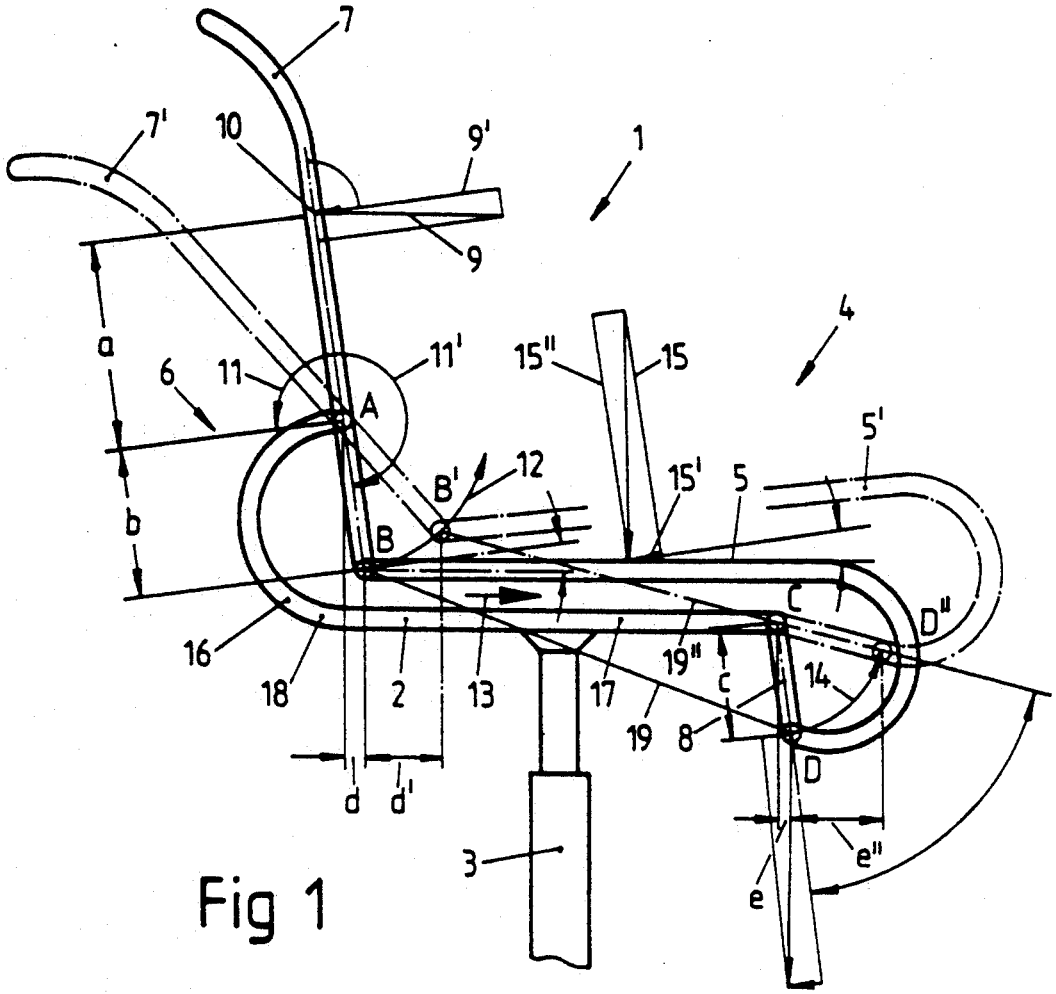

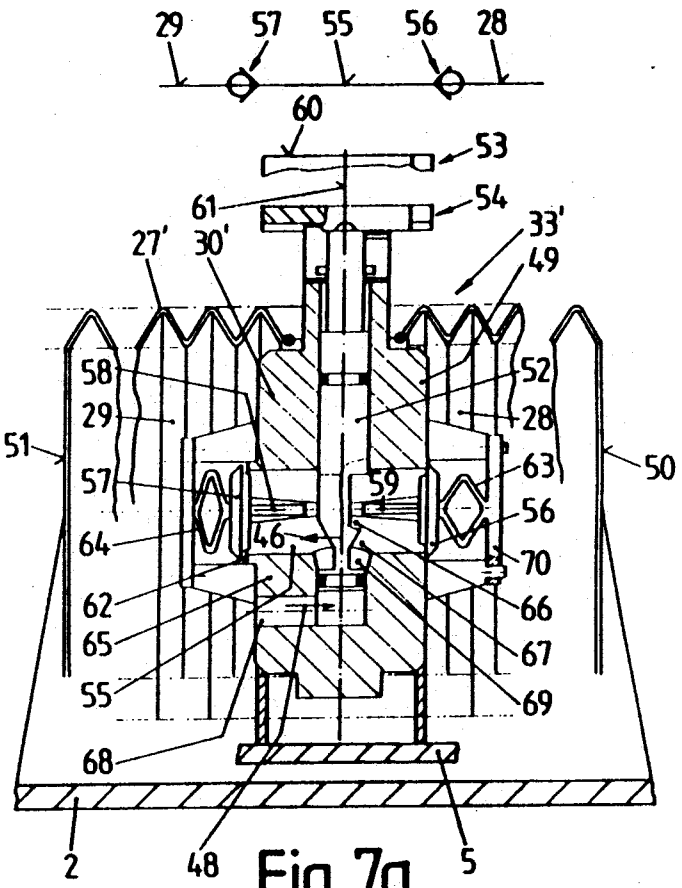
Fig 7a
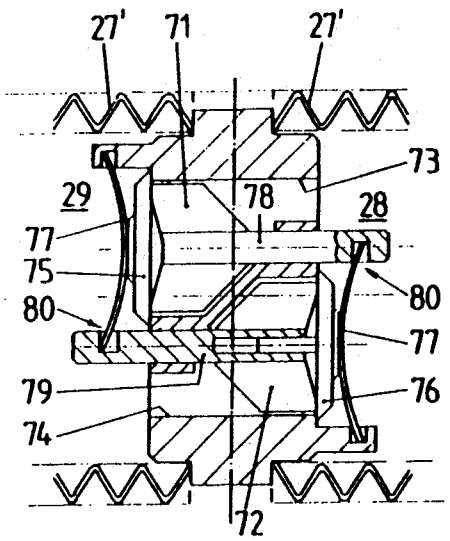
Fig 7c
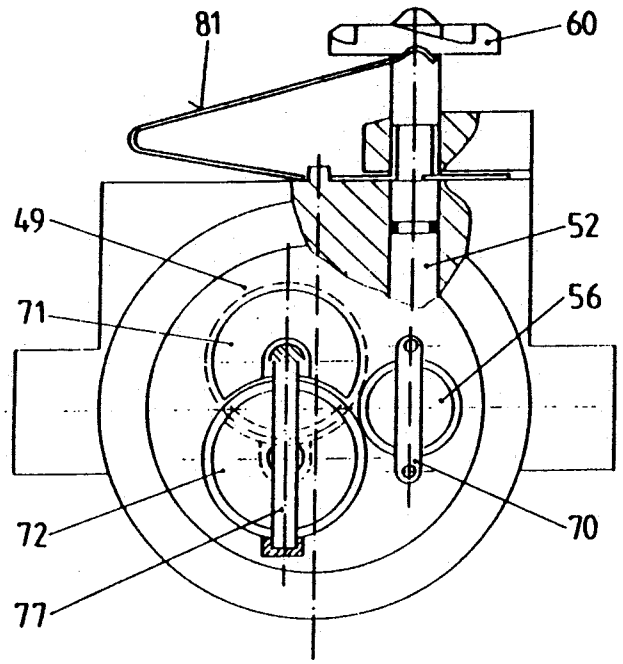
Fig 7b
Fig 7

SYNCHRONOUS ADJUSTING DEVICE FOR OFFICE CHAIRS OR THE LIKE

STATE OF THE ART

The invention starts from a synchronous adjusting device for office chairs, seat furniture or the like.

Where office chairs are concerned, the term "synchronous mechanism" means the arrangement of a combined or dependent back adjustment and seat adjustment, that is to say the adjustment of the back inclination fundamentally also results in an adjustment of the sitting surface.

Known office chairs have a relatively complicated mechanical construction which is distinguished by a multiplicity of articulation points for the purpose of coordinating the cycle of movement between the seat part and back part. Thus, the adjustment of the inclination of the back part should take place in such a way that a counterpressure or a corresponding counter moment rising with an increasing inclination is generated. The synchronous, that is to say simultaneous adjustment of the seat part, serves for adapting the chair to the physical characteristics of the user. For the adjustment, pressure units are usually employed additionally for influencing and damping the individual movements.

A particular problem of known office chairs is that they generally have to be adjusted to the weight or size of the user. A large heavy user exerts a substantially higher force on the back part than a lighter and smaller user. The same applies to the load on the seat part, the movement of which is associated with the movement of the back part.

ADVANTAGES OF THE INVENTION

The object on which the invention is based is to avoid the disadvantages described in relation to the state of the art and to propose a chair mechanism as a synchronous mechanism which is of extremely simple and effective construction, that is to say has few mechanical means and, if appropriate, can do without additional force accumulators and pressure units.

A further object of the invention is to equip such an office chair with a convenient adjusting mechanism which allows damped movements and retentions in any position without catching.

This object and others to become apparent as the specification progresses, are accomplished by the invention, according to which, briefly stated, the chair includes a carrier structure of fixed location, having front and rear regions and a back part having first and second locations of articulation disposed below one another. The first location of articulation of the back part is pivotally jointed to the rear region of the carrier structure, whereby upon pivotal movement of the back part, the second location of articulation moves along a circular path about the first location of articulation. The chair further has a seat part having front and rear regions. The rear region of the seat part is pivotally jointed to the second location of articulation of the back part. A single coupling component connects the front region of the seat part with the front region of the carrier structure. An arrangement compels an end of the single coupling component to travel in a circularly arcuate path having a center of curvature which is fixed relative to the carrier structure. The travelling end of the single coupling component is situated at all times at a height level which is below the second location of articulation of the back part.

Further advantageous and expedient developments of the invention for achieving the object according to the invention are contained in the subclaims.

The invention is based on the principal idea that, during the adjustment of the backrest, a restoring movement of the back part must take place as a function of the weight of the user. At the same time, the restoring moment must rise automatically with the increase in the inclination, since the lever arm for the torque increases constantly with the increase in inclination. Consequently, the counter moment must also increase constantly with an increase in the inclination of the back part.

According to the invention, such a counter moment or restoring moment during the adjustment of the back inclination is obtained, in the first place, in that the back part is mounted rotatably relative to the seat part at a distance in height, and a restoring force counteracting the leaning force of the user at the back leaning point acts in the lower region of the back part. The back part therefore acts in the manner of a rocker and is supported by the carrier structure at a fixed location and rotatably. The restoring force or counterforce in the lower region of the back part results from the weight of the user which brings about a counter moment via the connection of the seat part to the back part and, in the front seat region, via the deflection. At the same time, the greater the inclination of the back part, the higher the counter moment becomes This is the result of the lever effects caused by the deflection of the upper and lower portions of the back part and of the seat part in the front region in conjunction with the fixedly mounted centers of rotation.

According to the invention, therefore, the carrier structure is connected in the front region to the seat part pivotably via a pendulum lever which allows the movable mounting of the seat part. Instead of a pendulum lever, the front region of the seat part can also be connected to the carrier structure via a slotted-link guide or via a curved guide.

The movement of the front region of the seat part is brought about synchronously as a result of the adjustment of the back part, both the front and the rear region of the seat part executing an upwardly directed movement which generates an increasing lever arm for the restoring moment.

In an advantageous version of the invention, with the chair in the normal position the connecting joint between the back part and the seat part is virtually underneath the fixed bearing of the back part on the carrier structure, since, in this position, virtually no torque acts on the back part. However, the lower connection point can also be located somewhat in front of the perpendicular through the bearing point. A restoring moment caused by the seat load is thereby established directly whenever the back part is subjected to load. The lever arms on the back part below and above the bearing point on the carrier structure and the lever arm at the front articulation point of the seat part relative to the carrier structure are selected in such a way that the load on the back part always produces an adjustment of the inclination of the backrest or the back part since this is, of course, desirable. But this adjustment of the inclination of the back part and the forwardly directed upward movement of the front region of the seat part will always bring about restoring moments which are coordinated with the load on the seat part.

To achieve the desired moments and counter moments on the seat part, therefore, the front region of the seat part is so guided via the pendulum lever or by means of a slotted-link guide or curved guide that, when the back part is subjected to load, an upwardly directed pivoting movement with an increasing counter moment occurs. This upwardly directed pivoting movement counteracts the weight of the user, thereby generating an additional restoring moment of the back part.

It is advantageous, furthermore, if the carrier structure consists of a narrow elongate base spar which is arranged underneath the seat part and which extends over and beyond the rear region of the seat part. Attached to the end of the base spar is a stirrup-like transverse branch or a bow-like stirrup which connects the base spar to the two lateral bearing points for the back part. The two armrests can directly adjoin this bow-shaped stirrup. The advantage of this embodiment is that the chair need not have in its side regions any additional guides or supporting structures which can lead to jamming. Moreover, the back part can be made highly curved and bulged, in order to allow the user to adopt a sitting position arranged as far to the rear as possible. Finally, an attractive design becomes possible thereby.

The office chair according to the invention can be operated per se without any damping device or force accumulator, since, during the adjustment, the user himself serves as a weight counterbalance for the generation of restoring forces. In an advantageous embodiment of the invention, however, a damping of the movement and a retention of specific sitting positions can be advantageous. For this, in a development of the invention, there is a lifting cylinder which can be loaded on both sides or a correspondingly acting bellows which is tensioned between the fixed carrier structure and the seat part. The adjusting movement of the seat part and of the back part can be influenced by the conveyance of the fluid between the front and rear parts of the lifting cylinder of the bellows. Different sitting parameters can be set by throttling or blocking the fluid flow.

DRAWING

Figure 2:
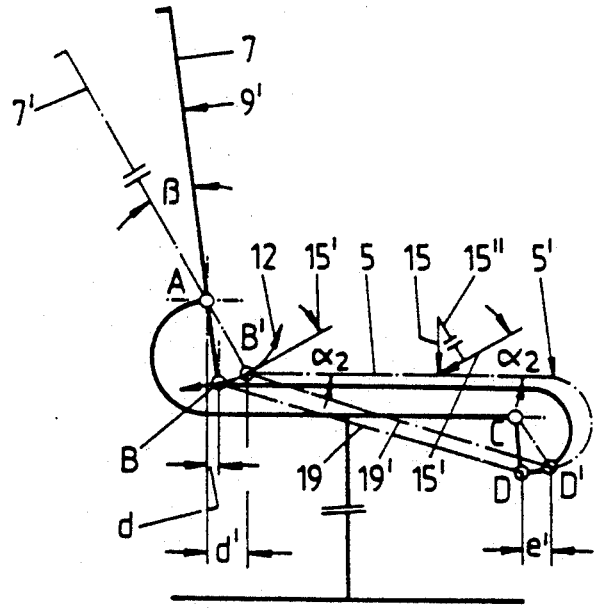
Figure 3:
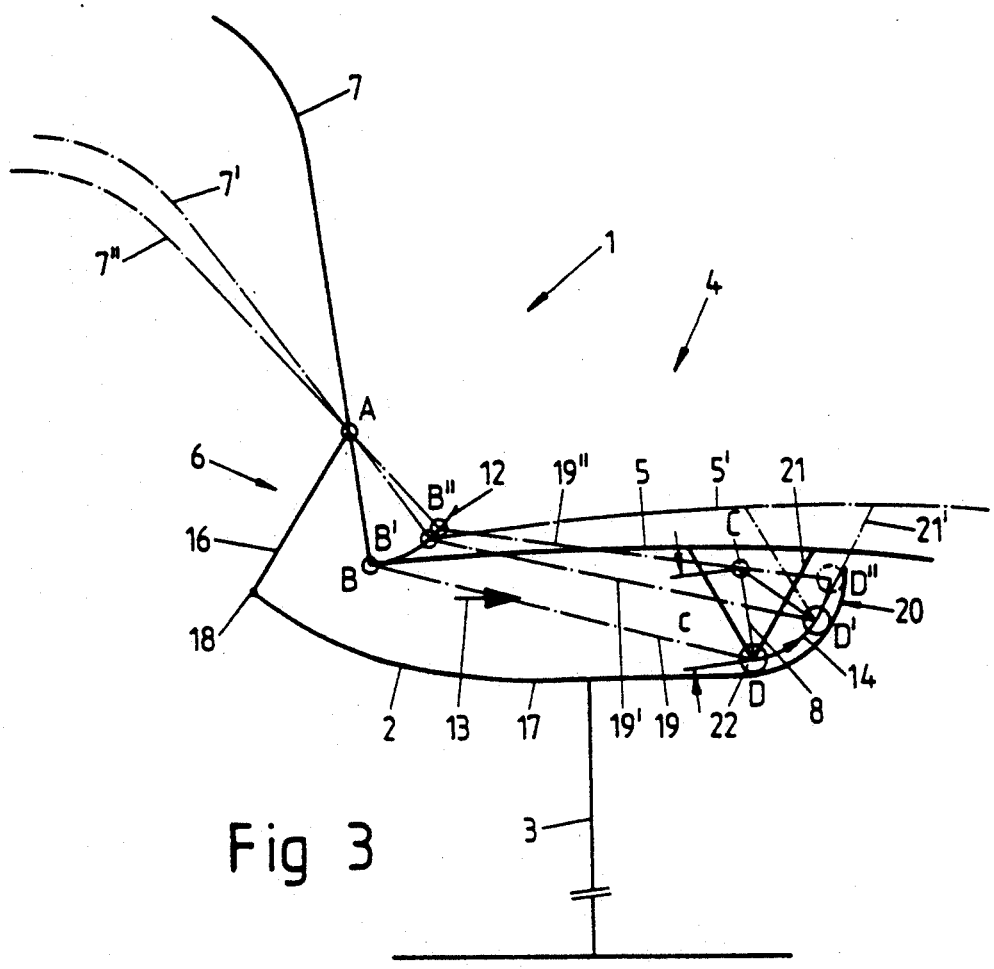
Figure 4:
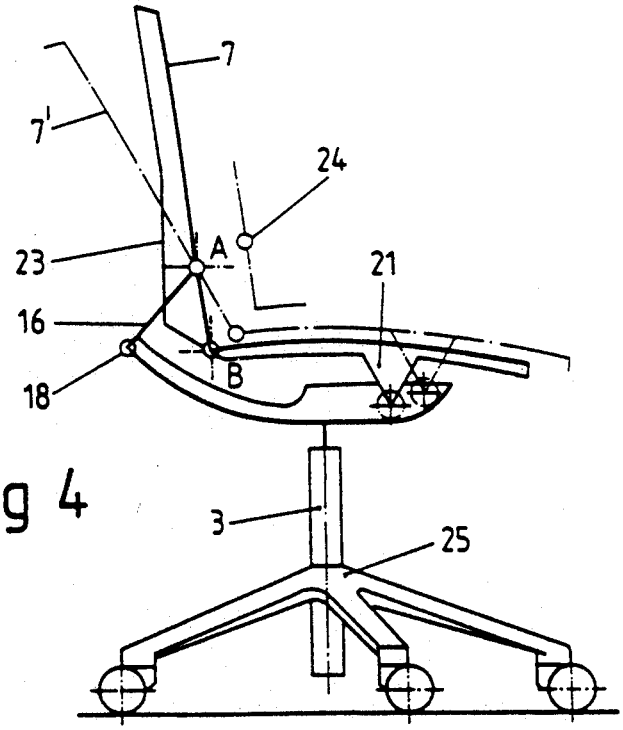
Figure 5:
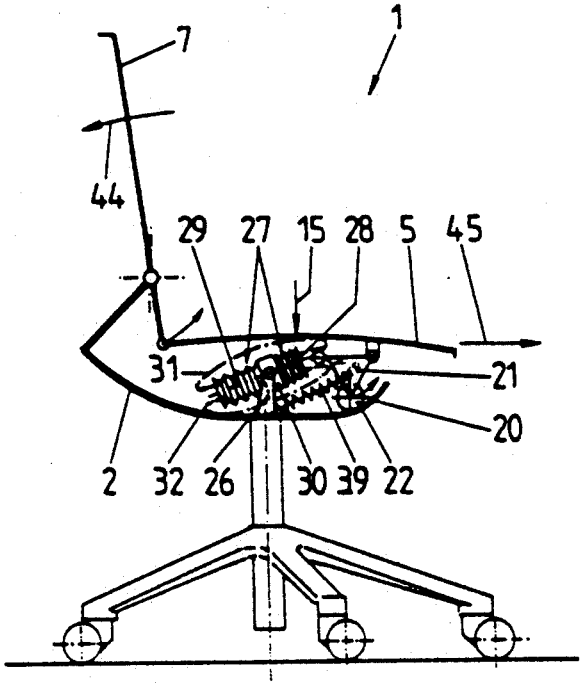
Figure 6:
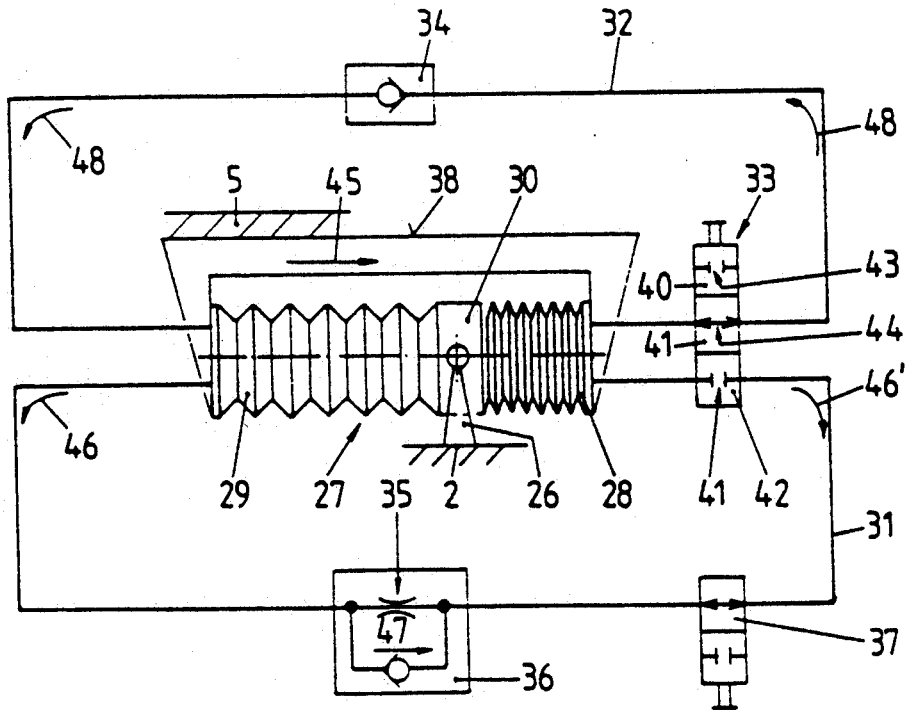

Further details of the invention are illustrated in the drawing and explained in more detail in the following description. In the drawing:

FIG. 1 shows a diagrammatic representation of an office chair with a 4-point synchronous adjusting device, FIG. 2 shows a diagrammatic representation according to FIG. 1 with a different seat-part and back-part adjustment, FIG. 3 shows a modified exemplary embodiment with an alternative seat-part control, FIG. 4 shows an extended exemplary embodiment according to FIG. 3, FIG. 5 shows an exemplary embodiment of the invention with an additional damping and retaining device, FIG. 6 shows a diagrammatic representation of the damping and retaining device, and FIG. 7 shows an exemplary embodiment of an alternative valve arrangement in the exemplary embodiment according to FIG. 6.

DESCRIPTION OF AN EXEMPLARY EMBODIMENT

The office chair 1 illustrated in FIG. 1 consists of a carrier structure 2 of fixed location, with a chair column 3 and with a seat part 5 connected to it in the front chair region 4 and a back part 7 articulated in the rear chair region 6. The seat part 5 is connected in an articulated manner to the carrier structure 2 via a pendulum lever 8. The back part 7 is connected rotatably to the carrier structure 2 at the articulation point A of fixed location. The articulated connection between the seat part 5 and the back part 7 is made at the articulation point B. The pendulum lever 8 is articulated at a fixed location on the carrier structure 2 at the point C. The articulated connection between the pendulum lever 8 and the seat part 5 is made at the point D (lever arm "c"). The a points A, B, C and D form the basis for the 4-point synchronous adjusting device of the office chair.

Both FIG. 1 and FIG. 2 show the lever ratios and force ratios. These are explained as follows:

The leaning force 9 exerted on the back part 7 by a user, not shown in any more detail, at the leaning gravity center 10 brings about a torque 11 which is directed counterclockwise about the center of rotation A and which is calculated from the leaning force 9' resulting from the parallelogram of forces times the lever arm a (distance between point A and point 10) (the force 9' is perpendicular to the connecting line 10-A). This torque 11 gives rise to a circular movement 12 of the point B, as represented by the arrow. The circular movement takes place as a result of the fixed mounting of the back part 7 at the center of rotation A. The distance A-B is designated by "b".

The circular movement of the point B (arrow 12) ensures, furthermore, that the seat part 5 moves to the right in the figure in the direction of the arrow 13. As a result of the articulation of the seat part 5 on the pendulum lever 8 at the point C of fixed location, the point D which constitutes one end of the pendulum lever 8, executes an upwardly directed circular movement 14 with the lever arm "c" according to the arrow 14. The lever arm c constitutes the radius of curvature of the circular travel path of point D, whereas point C constitutes the center of curvature of the circular travel path. As represented by dot-and-dash lines in FIGS. 1 and 2, the seat part 5 thereby rises into the position 5'. The length of the lever arm of the pendulum lever 8 is denoted by "c".

In the representation according to FIG. 1, the office chair is approximately in the neutral initial position. Thus, the perpendiculars for the points A and B are at a distance $d>0$. The result of this is that any load on the seat part 5 already generates a restoring moment which is designated as a restoring torque 11'. In any events, the connecting point B will be located below the center of rotation A ($d=0$) or to the right of this in FIG. 1 ($d \geqq 0$), in order to generate a restoring moment 11' when the seat part 5 is to load. The horizontal distance "e" between the points C and D also generates an additional restoring moment.

In FIGS. 1 and 2, the user's body weight 15 is shown. This body weight 15 can, according to the representation of FIG. 1, be broken down into a parallelogram of forces with the forces 15' and 15'', the force 15' being projected to the point B (same angle $\alpha_1$) and being perpendicular to the connecting line 10-B. The force 15' thus generates a countertorque 11' which is obtained from the amount of the force 15' times the lever arm b. As is evident from FIGS. 1 and 2, the force 15' rises with an increasing rearward deflection of the back part 7 (angle $\alpha_1 \rightarrow \alpha_2$), that is to say with an increase of the portion d. This means that the restoring moment 11' caused by the user's body weight 15 increases with an increasing inclination nation $\beta$ of the back part, in order to counteract the constantly increasing moment 11. The restoring force 15' thus always takes the form of a perpendicular to the connecting line 10-B. Likewise, the resultant force 15" is parallel to the connecting line 10-B. Moreover, in FIGS. 1 and 2, the respectively offset points representing the increased inclination 7' of the backrest are identified by corresponding apostrophes.

Accordingly, the point B travels to the point B' and the point D to the point D' (FIG. 2). The points A and C remain at a fixed location.

In the invention, therefore, the torque 11 occurring as a result of the back force 9 is counteracted by a counter moment 11' occurring as a result of the weight 15. By an optimum design of the lever arms a and b for generating the torques 11, 11' and by the lever arm c for generating pivoting movement 14, an optimum coordination of the office chair, without an additional restoring spring, can be achieved. The lever arm c will always be lower than the lever arm b, in order, when there is an increase in the inclination of the back part 7, to prevent the possibility of buckling at the point B. Further, as seen in FIGS. 1 and 2, the lever arm c is shorter than the lever arm b. In the extended position, the lever arm c thereby forms a gentle limitation of the inclination in relation to the connecting line B-C. The extended position is represented by dot-and-dash lines in FIG. 1 with the straight connecting line B-C-D". This arrangement prevents the backrest from buckling, since the connecting points B-C-D" lie on one line (19") and the point B thus cannot rotate further about the point A. This extended position is accordingly the limiting position of the chair which is established automatically as a result of the lever ratios. At the same time, the restoring force or restoring moment 11' rises with an increasing back inclination as a result of the lever arms d' and e' increasing thereby. This leads to a progressive rise of the restoring moment and to a gentle limitation of the backrest adjustment. The user can assist the restoring effect by slight leg pressure in the front seat region. This is true especially in the rear backrest position 7" with a high lever arm e" (see FIGS. 1 and 2).

The rearwardly directed bow 16 of the carrier structure 2 serves both mechanical and safety purposes with regard to jamming of movable parts. Thus, the carrier structure of fixed location consists of a lower base member 17 which is arranged centrally and symmetrically underneath the seat part 5 and which projects rearwards beyond a perpendicular through the center of rotation A (point 18) and from the end of which (point 18) a kind of stirrup-shaped branch 16 extends upwards to the lateral regions or points A of the back part 7 (see especially FIGS. 3 and 4).

FIGS. 3 and 4 illustrate an alternative embodiment of the mounting of the front region of the seat part 5. Instead of the guidance of the point D about the fixed center of rotation C by means of the pendulum lever 8 with the lever arm c in FIGS. 1 and 2, in the exemplary embodiment according to FIG. 3 a roller mounting along a curve 20 with the mid-point C and radius c is selected. Thus, the seat part 5 is connected firmly to a roller block 21 and a roller 22 which rolls on the fixed curve 20 of the carrier structure 2. The roller 22 corresponds to the point D in FIGS. 1 and 2. When the back part 7 is inclined into the position 7' by rotation about the fixed center of rotation A, once again there is a displacement of the point B into the position B' according to the arrow 12, so that the seat part rises from the position 5 into the position 5' and is displaced forwards. At the same time, the roller block 21 travels forwards into the position 21' and the roller 22 or point D into the point 22', D'. The upwardly directed curved shape 20 therefore gives rise to the same movement as the rotational movement of the point D along the curve 14 in FIG. 1. Instead of the roller mounting 19, a slotted-link guide can also be provided correspondingly.

In FIGS. 1 to 3, the imaginary connecting line B-D is designated by the reference symbol 19. The limiting position of the back adjustment is reached when the points B-C-D" lie on one line 19", the point C in FIG. 3 being considered as the mid-point of the curve 14 or 20.

In the embodiment according to FIG. 4, as a development of the principle according to FIG. 3 a back part 7 formed on to the rear, with a bulge 23 provided in the lower region, is shown. As a result of this bulge 23, the user can sit even further rearwards in the chair, so that the diagrammatically illustrated hip point 24 of a user comes nearer to the center of rotation B. The so-called "shirt pull-out effect" is thereby reduced to a minimum.

A chair cross 25 is also indicated on the chair column 3 in FIG. 4.

The invention according to FIGS. 1 to 4 can, in principle, be used without any damping means or restoring means. This arises, as described, as a result of the torque 11 brought about by the back force 9 and the countertorque 11' from the weight 15.

For a more comfortable or different adaptation of the office chair, influencing the movement process according to the invention, as represented in FIGS. 5 and 6, can be advantageous. For this, a bearing block 26 for a double-acting bellows 27 is fastened to the fixed carrier structure 2. The bellows consists of a front chamber 28 and of a rear chamber 29 which are separated from one another by a partition wall 30. The middle partition wall 30 at the same time forms the cylindrical counterbearing for the bearing block 26. The two ends of the concertina chambers 28, 29 are surrounded by a bracket 38 and are connected rigidly to this. The bracket 38 is itself connected firmly to the seat part 5 and executes its movements. A kinematic reversal is possible. The inner spaces 28, 29 of the bellows 27 are filled with a fluid, for example a hydraulic oil or water. At the same time, the two chambers 28, 29 are connected to one another via two ring lines 31, 32 guided separately. The ring line 32 constitutes a restoring circuit for the unoccupied chair and the ring line 31 an adjusting circuit and a damping and retaining circuit for the occupied chair. A directional valve 33 regulates the fluid flow between the chambers 28, 29 according to different positions. A nonreturn valve 34 in the ring line 32 and a throttle 35 with a nonreturn valve 36 and retaining valve 37 in the ring line 31 serve for influencing the fluid in different sitting positions. The end regions of the chambers 28, 29 are connected firmly to the seat part 5 via the bracket 38. An additional restoring spring 39 is designed as a tension spring and returns the office chair to its initial position, as shown in FIG. 5.

The adjusting mechanism of FIG. 5 is described as follows in terms of its mode of operation according to the basic representation of FIG. 6:

1. Chair occupied by a user

Insofar as the seat part 5 is loaded by a user with the weight 15, the directional valve 33 is actuated and displaced downwards out of the position according to FIG. 6. The upper chamber 40 of the valve 33 thereby joins the circuit 32 and closes this, so that no more fluid can flow through (interruption 43), whilst the middle chamber 41 joins the circuit 31 and opens this (arrow 44). The lower chamber 42 of the valve 33 comes out of engagement. As a result of the rearward actuation of the back part 7, the seat part 5 is displaced forwards. The concertina 27 is likewise displaced forwards, that is to say to the right in FIG. 6, via the bracket 38. As a result of the fixed mounting of the middle part 30 of the concertina 27 on the bearing block 26, the fluid therefore has to flow from the chamber 29 via the line 31 into the chamber 28 (arrow 46). This takes place via the nonreturn valve 36 (arrow 47) and via the open retaining valve 37. This flow occurs largely undamped, that is to say without any influence by the throttle 35. However, a minimum damping of the movement occurs as a result of line-flow losses. Of course, an additional damping member can be introduced into the circuit 31.

If required, the backrest adjustment can be retained in any position as a result of the actuation of the retaining valve 37. The circuit in the ring line 31 is thereby broken and a rigid connection is made between the bearing block 26 and seat part 5 via the concertina 27.

When the backrest is restored forwards, the seat part is displaced rearwards. In this case, the fluid flows from the chamber 28 via the line 31 and via the throttle 35 to the chamber 29 (arrow 46'). Restoration takes place damped as a result of the throttle 35. With the chair occupied, therefore, only the ring line 31 is in operation. Fluid flows through it counterclockwise (arrow 46) when there is an increase in the inclination of the back part and clockwise (arrow 46,) when there is a reduction in the inclination of the back part.

2. Chair without a user

When the chair is unoccupied, the valve 33 returns to the position according to FIG. 6. The fluid can thereby flow only through the chamber 41 and therefore through the upper ring line 32, whilst the lower ring line 31 is blocked. The upper ring line 32 serves for the once-only restoration of the backrest when the latter is inclined rearwards. In this case, the fluid must flow from the front chamber 28 via the line 32 and via the nonreturn valve 34 to the rear chamber 29 (arrow 48). The restoring spring 39 assists this operation. When the backrest 7 is in the normal position, the line 32 is also blocked by the nonreturn valve 34. An adjustment of the backrest is possible only as a result of the actuation of the valve 33.

FIG. 7 illustrates an alternative exemplary embodiment of a valve arrangement according to the exemplary embodiment shown in FIGS. 5 and 6. This relates especially to the arrangement of the multidirectional valve 33 in FIG. 6.

In the exemplary embodiment according to FIG. 7, the directional valve 33' is located in the interspace between the front chamber 28 and rear chamber 29, that is to say the valve 33' itself forms the partition wall 30' of the double-acting concertina. Instead of the two ring lines 31, 32 shown in FIG. 6, the fluid is conveyed from one chamber to the other chamber directly by the directional valve 33'.

As shown in section in FIG. 7*a*, for this the directional valve 33' has a valve housing 49 to which the two chambers 28, 29 of the double-acting concertina 27' are adjacent on the left and right. The two ends 50, 51 of the concertina 27' are connected fixedly to the carrier structure 2 in a kinematic reversal in relation to the exemplary embodiment according to FIG. 6, whilst the valve housing 49 is connected to the seat part 5 and is therefore movable to and fro. This connection is represented symbolically in FIG. 7*a*.

The directional valve 33' has a vertically adjustable actuating tappet 52 which is vertically displaceable between an upper position 53 and a lower position 54. This adjustment takes place simultaneously with the loading of the chair by the user, that is to say in the upper position 53 the chair is under no load, whilst in the lower position 54 the chair is loaded. FIG. 7*a* shows the lower, that is to say the occupied chair position. The tappet 52 reaches in its lower region into a horizontal passage bore 55 which connects the two chambers 28, 29 and which can be closed by nonreturn valves 56 and 57. Thus, the nonreturn valves 56, 57 are respectively designed to transmit from the passage bore 55 to the chambers 28, 29 and can block in the opposite direction This is represented symbolically once more above FIG. 7*a*. The nonreturn valves 56, 57 possess centrally on their plate surface actuating pins 58, 59 which reach into the passage bore 55 as far as the actuating tappet 52 and which interact with the predetermined curved shape on the tappet cylinder of the actuating tappet 52. By manual rotation of the setting wheel 60 through 90° about the longitudinal axis 61, different curves of the tappet-cylinder surface can be actuated. For example, in FIG. 7*a*, the left actuating pin 58 of the nonreturn valve 57 for the chamber 29 bears against the outer surface of the actuating tappet 52, so that the nonreturn valve is opened in this position. Thus, via the annular gap 62, fluid can pass from the chamber 29 via the passage bore 55 and the nonreturn valve 56 into the chamber 28. The nonreturn valve 56 opens automatically counter to the pressure of the press spring 63. The nonreturn valve 57 has a corresponding press spring 64.

As described in relation to FIG. 6 with regard to the open ring line 31, during the adjustment of the inclination of the back part the fluid will flow from the chamber 29 into the chamber 28, and vice versa. In this case, the two actuating pins 58, 59 bear against the outer cylindrical surface of the actuating tappet 52, so that the two nonreturn valves 56, 57 are pressed radially outwards and are consequently open (in FIG. 7*a*, the right nonreturn valve 56 is conversely shown closed). The valve seat of the nonreturn valve 57 possesses, in the region of the annular gap 62, an additional annular shoulder 65 which increases the flow resistance for the fluid through this annular gap. The result of this is that, when being restored forwards, the backrest is guided with more damping than during the rearward adjustment .The valve seat therefore acts in a similar way to the throttle 35 in FIG. 6.

To produce a retention of the backrest adjustment, the passage of the fluid through the passage bore 55 must be blocked. This position is shown in FIG. 7*a* for the right nonreturn valve 56. As a result of a rotation of the setting wheel 60 through 90°, the actuating pins 58, 59 slide into recesses 66 on the outer cylindrical surface of the tappet 52, so that the two nonreturn valves 56, 57 shift radially inwards and are consequently closed In this case, no fluid can pass in whatever direction from one chamber to the other chamber This corresponds to the retaining valve 37 in FIG. 6.

When the chair is no longer occupied, the actuating tappet 52 shifts from the lower position 54 into the upper position 53. In this case, the actuating pins 58, 59 slide into further recesses 67 in the lower region of the actuating tappet 52, with the result that the valves are closed. However, as a result of the lift of the actuating tappet 52, a bypass bore 68 is opened by the lower tappet pin 69, so that fluid can pass from the left chamber 29 into the passage bore 55 and from there by the nonreturn valve 56 into the right chamber 28. This bypass bore 68 with the fluid passage described corresponds to the ring line 32 in FIG. 6.

Since, in the exemplary embodiment according to FIG. 7*a* the directional valve 33' is displaced each time together with the seat part 5, when the backrest inclination is restored there is a flow movement from the chamber 29 into the chamber 28, because the valve moves from right to left in FIG. 7*a*. Consequently, the directions of flow are reversed in comparison with the representation of FIG. 6. The directions of flow 46, 48 of the fluid in the directional valve 33' are drawn accordingly in FIG. 7*a*.

FIG. 7*b* shows an end view of the directional valve according to FIG. 7*a*. Like parts are designated by the same reference symbols. The nonreturn valve 56 with press spring 63 is fastened to the valve housing 49 via a connecting web 70.

As shown in FIG. 7*b* in conjunction with FIG. 7*c*, the valve housing 49 additionally possesses two safety valves 71, 72 which close passage bores 73, 74 between the chambers 28, 29. The valve plates 75, 76 are pressed against the valve seat by leaf springs 77. These additional safety valves serve for protecting the concertina 27 or 27' in the event that the inclination of the backrest is actuated very abruptly and with excessive force and flow equalisation, with the chair unoccupied, via the directional valve 33 or 33' cannot take place. In this case, a flow of the fluid between the two chambers 28, 29, and vice versa, can take place via the safety valves 71, 72. The sectional representation in FIG. 7*c* shows in longitudinal section the safety valves 71, 72 arranged one above the other. The longitudinal tappets 78, 79 serve at the same time as a one-sided mounting with recesses 80 for the leaf springs 77.

FIG. 7*b* also shows a V-shaped retaining stirrup 81 for a 90° adjustment movement of the setting wheel 60, in order to reach the particular position for retention or for releasing the retention of the backrest adjustment.

The invention is not restricted to the exemplary embodiment described and illustrated. On the contrary, it also embraces all modifications and developments of the basic idea according to the invention which are open to an average person skilled in the art.

We claim:

1. A chair comprising (a) a carrier structure of fixed location; said carrier structure having front and rear regions;

(b) a back part having first and second locations of articulation; said first location of articulation being at a height level above said second location of articulation; said first and second locations of articulation defining a length portion of said back part; said first location of articulation of said back part being pivotally jointed to said rear region of said carrier structure, whereby upon pivotal movement of said back part, said second location of articulation moves along a circular path about said first location of articulation;

(c) a seat part having front and rear regions; said rear region of said seat part being pivotally jointed to said second location of articulation of said back part;

(d) a single coupling component connecting said front region of said seat part with said front region of said carrier structure such that the front regions of the seat part and the carrier structure are movable relative to one another; said single coupling component having an end; and (e) means for compelling said end of said single coupling component to travel in a circularly arcuate path having a center of curvature being fixed relative to said carrier structure; said end of said single coupling component being situated at all times at a height level below the second location of articulation of said back part.

2. The chair as defined in claim 1, wherein a distance between said center of curvature and said end of said single coupling component constitutes a radius of curvature of said path; said radius of curvature being situated at all times below said length portion of said back part.

3. The chair as defined in claim 1, wherein a distance between said center of curvature and said end of said single coupling component is smaller than said length portion of said back part.

4. The chair as defined in claim 1, wherein said single coupling component is a pendulum lever having spaced first and second locations of articulation; said first location of articulation of said pendulum lever constituting said center of curvature and being pivotally jointed to said front region of said carrier structure and said second location of articulation of said pendulum lever constituting said end of said single coupling element and being pivotally jointed to said front region of said seat part, whereby upon pivotal movement of said pendulum lever, said second location of articulation of said pendulum lever moves along said circularly arcuate path; the pivotal connection between the pendulum lever and the carrier structure constituting said means for compelling said end of said single coupling component to travel in a circularly arcuate path.

5. The chair as defined in claim 1, wherein said end of said single coupling component has a top dead center position between said seat part and said carrier structure; in said top dead center position said second location of articulation of said back part, said center of curvature and said end of said single coupling component lie on a single straight line.

6. The chair as defined in claim 1, wherein in an unloaded state of the chair the second location of articulation of said back part is situated below the first location of articulation of said back part at an offset d such that a torque generated about the first location of articulation of said back part by a load imparted on the back part is counteracted by a restoring torque generated about the first location of articulation of said back part by a load imparted on the seat part.

7. The chair as defined in claim 1, wherein said carrier structure includes (a) a base member situated centrally underneath said seat part and (b) an extension connected to said base member in said rear region of the carrier structure, said extension having an upwardly oriented course and a terminus to which said first location of articulation of said back part is pivotally jointed.

* * * * *